US010345732B2

(12) United States Patent
Kurosawa et al.

(10) Patent No.: US 10,345,732 B2
(45) Date of Patent: Jul. 9, 2019

(54) IMAGE WRITING DEVICE, IMAGE FORMING APPARATUS, AND PITCH UNEVENNESS SUPPRESSING METHOD

(71) Applicant: Konica Minolta, Inc., Tokyo (JP)

(72) Inventors: Takashi Kurosawa, Hachioji (JP); Naoki Tajima, Hachioji (JP); Daisuke Kobayashi, Hino (JP)

(73) Assignee: KONICA MINOLTA, INC., Tokyo (JP)

( * ) Notice: Subject to any disclaimer, the term of this patent is extended or adjusted under 35 U.S.C. 154(b) by 30 days.

(21) Appl. No.: 15/875,697

(22) Filed: Jan. 19, 2018

(65) Prior Publication Data

US 2018/0231911 A1 Aug. 16, 2018

(30) Foreign Application Priority Data

Feb. 13, 2017 (JP) ..... 2017-023751

(51) Int. Cl.

| | |
|---|---|
| ***G03G 15/04*** | (2006.01) |
| ***G03G 15/043*** | (2006.01) |
| ***G03G 15/00*** | (2006.01) |
| *G03G 15/01* | (2006.01) |

(52) U.S. Cl.

CPC ..... *G03G 15/043* (2013.01); *G03G 15/0409* (2013.01); *G03G 15/55* (2013.01); *G03G 15/0189* (2013.01)

(58) Field of Classification Search

CPC .. G03G 15/043; G03G 15/0409; G03G 15/55; G03G 15/0189

See application file for complete search history.

(56) References Cited

U.S. PATENT DOCUMENTS

| | | | | |
|---|---|---|---|---|
| 8,823,762 | B2 * | 9/2014 | Yamazaki | G03G 13/04 347/236 |
| 9,557,563 | B2 * | 1/2017 | Suzuki | G02B 26/12 |

FOREIGN PATENT DOCUMENTS

| | | | |
|---|---|---|---|
| JP | H-2131956 | A | 5/1990 |
| JP | 2685345 | B2 | 8/1997 |
| JP | 2015227986 | A | 12/2015 |

* cited by examiner

*Primary Examiner* — Hoang X Ngo

(74) *Attorney, Agent, or Firm* — Lucas & Mercanti, LLP

(57) ABSTRACT

Provided is an image writing device including a deflector having deflective reflection surfaces for deflecting light flux emitted from a light source and a scanning imaging optical system that condenses the light flux as a light spot on a scanned surface of a latent image carrier, and performing optical scanning on the scanned surface at a constant speed, the image writing device further including: a surface detector that detects a deflective reflection surface that deflects the light flux; a storage that prestores a beam irradiation position in a sub scanning direction corresponding to each main image height on each of the deflective reflection surfaces; and a hardware processor that controls, on the basis of a beam irradiation position in the sub scanning direction corresponding to each main image height on the deflective reflection surface a light quantity of the light flux to be irradiated to the beam irradiation position.

17 Claims, 8 Drawing Sheets

IMAGE WRITING DEVICE, IMAGE FORMING APPARATUS, AND PITCH UNEVENNESS SUPPRESSING METHOD

The entire disclosure of Japanese patent Application No. 2017-023751, filed on Feb. 13, 2017, is incorporated herein by reference in its entirety.

BACKGROUND

Technological Field

The present invention relates to an image writing device, an image forming apparatus including the image writing device, and a pitch unevenness suppressing method.

Description of the Related Art

Conventionally, image forming apparatuses such as laser printers and digital copying machines are mounted with an image writing device that scans a photoreceptor using a semiconductor laser emitted from a light source.

In recent years, higher speed and higher density are demanded for image writing devices. Along with this, higher performance is demanded also for scanning optical systems.

However, demands for processing of parts such as optical elements are at a level exceeding its limit, and thus it is urgent to deal with this issue. Especially with laser scanning optical systems, as the speed increases, the number of light emitting points of a laser has also increased from two beams to four beams, and to eight beams. Thus, multiple beams are more in use. Here, for example, in a case where the number of light emitting points of a laser is eight, the number of reflecting surfaces of a deflector is six, and the writing density is 1200 dpi, one revolution of the deflector is equal to the spatial frequency for 1 mm of an image. Since 1 mm of the spatial frequency is a pitch that is easy to be visually recognized with human eyes, in a case where there is a difference in density on the image due to tilting of the deflector or other reasons, this becomes a major factor of quality deterioration. Regarding the tilting, however, high-precision processing of surfaces has almost reached its limit, and thus a countermeasure is demanded. In other words, unless a countermeasure considering error factors is taken, a demanded performance cannot be satisfied.

As described above, the accuracy of tilting with respect to the number of revolutions of a deflector has almost reached its limit. When a deflector is tilted, an irradiation position of a beam irradiated from a light source deviates in the sub scanning direction, thus resulting in pitch unevenness.

As a method of suppressing pitch unevenness, a method of correcting the light quantity by changing the light quantity for each scanning line is disclosed (for example, see JP 2015-227986 A and JP 2685345 B2).

Also disclosed is a method of suppressing density unevenness in the sub scanning direction by recording the amount of tilting for each deflective reflection surface and uniformly changing the light quantity (for example, see JP H2-131956 A).

Meanwhile, when a deflector is tilted as described above, a beam irradiation position in the sub scanning direction changes for each image height (main image height) in the main scanning direction.

In the techniques described in JP 2015-227986 A, JP 2685345 B2, and JP H2-131956 A, however, a beam irradiation position in the sub scanning direction is uniformly corrected of the light quantity for each deflective reflection surface, and thus there is a problem that pitch unevenness cannot be suppressed accurately.

SUMMARY

It is an object of the present invention to provide an image writing device capable of more accurately suppressing pitch unevenness caused by tilting of a deflector, an image forming apparatus including the image writing device, and a pitch unevenness suppressing method.

To achieve the abovementioned object, according to an aspect of the present invention, an image writing device reflecting one aspect of the present invention comprises a deflector having a plurality of deflective reflection surfaces for deflecting light flux emitted from a light source at a constant acceleration and a scanning imaging optical system that condenses the light flux deflected by the deflector as a light spot on a scanned surface of a latent image carrier having a charge generation layer and a charge transport layer, the image writing device performing optical scanning on the scanned surface at a constant speed, wherein the image writing device further comprises:

a surface detector that detects a deflective reflection surface that deflects the light flux out of the plurality of deflective reflection surfaces;

a storage that prestores a beam irradiation position in a sub scanning direction corresponding to each main image height on each of the deflective reflection surfaces; and a hardware processor that controls, on the basis of a beam irradiation position in the sub scanning direction corresponding to each main image height on the deflective reflection surface detected by the surface detector, the beam irradiation position prestored in the storage, a light quantity of the light flux to be irradiated to the beam irradiation position.

BRIEF DESCRIPTION OF THE DRAWINGS

The advantages and features provided by one or more embodiments of the invention will become more fully understood from the detailed description given hereinbelow and the appended drawings which are given by way of illustration only, and thus are not intended as a definition of the limits of the present invention.

DETAILED DESCRIPTION OF EMBODIMENTS

Hereinafter, one or more embodiments of the present invention will be described in detail with reference to the drawings. However, the scope of the invention is not limited to the disclosed embodiments.

[Configuration of Image Forming Apparatus]

Figure 1:
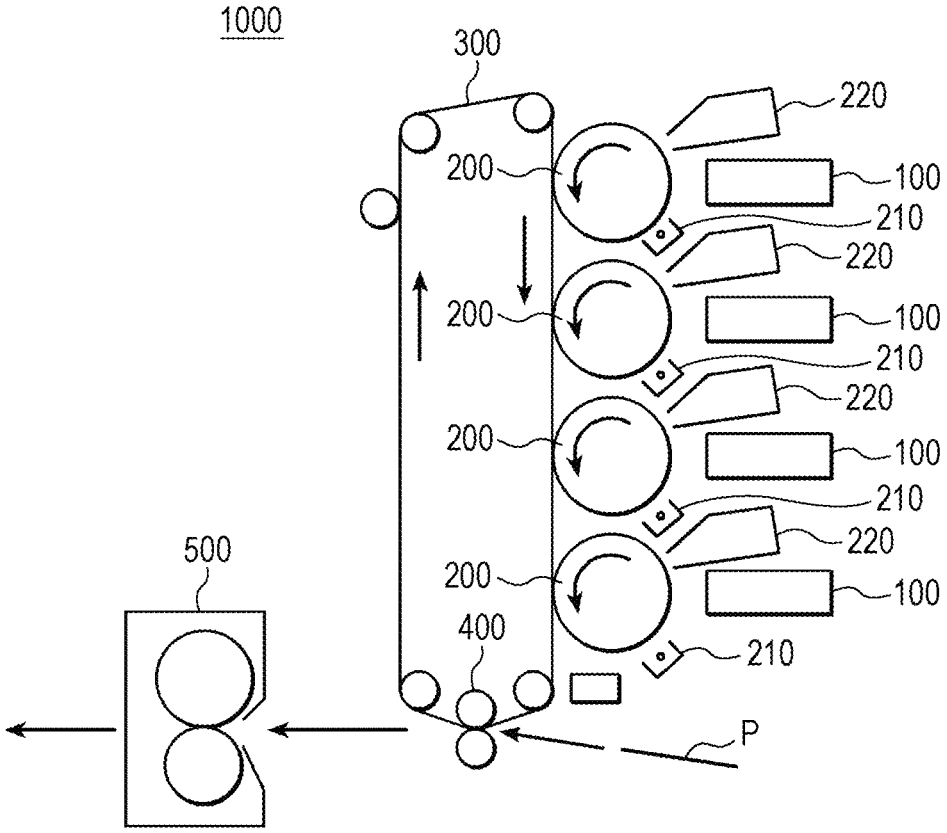
FIG. 1 is a diagram illustrating a schematic configuration of an image forming apparatus according to the present embodiment.
Figure 2:
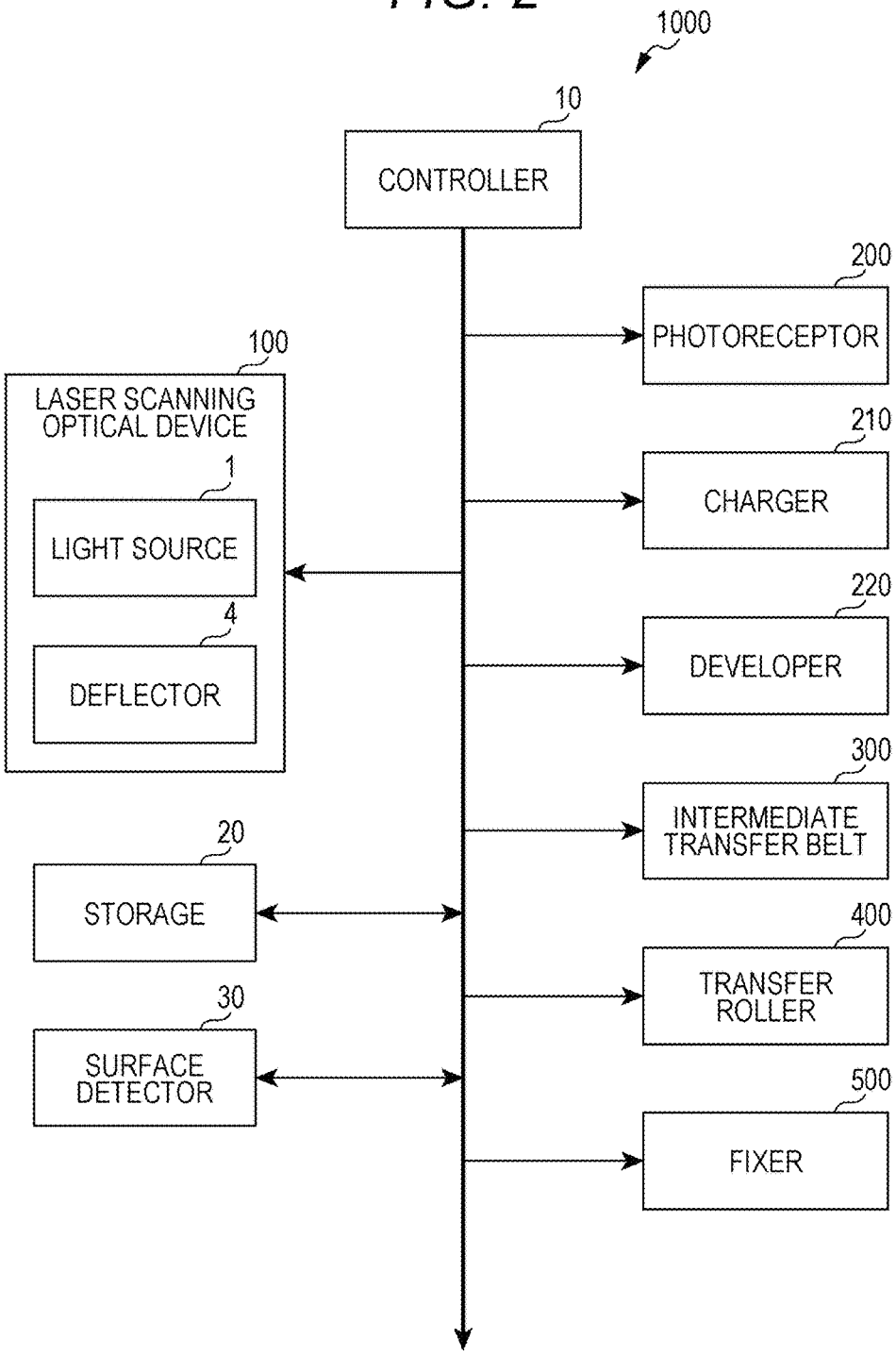
FIG. 2 is a functional block diagram illustrating a control structure of the image forming apparatus according to the present embodiment.

An image forming apparatus 1000 according to the present embodiment is used as, for example, a laser printer, a digital copying machine, or the like. The image forming apparatus 1000 includes: as illustrated in FIGS. 1 and 2, a plurality of laser scanning optical devices 100 of respective colors of cyan, magenta, yellow, and black; a photoreceptor (latent image carrier) 200 such as a photoreceptor drum provided corresponding to the laser scanning optical devices 100 and having a charge generation layer and a charge transport layer; a charger 210 for charging the photoreceptor 200; a developer 220 for supplying a developing agent to the photoreceptor 200 irradiated with light to develop the electrostatic latent image into an image formed by the developing agent; an intermediate transfer belt 300; a transfer roller (transferor) 400 for transferring the image formed by the developing agent onto a paper P; a fixer 500 for fixing the image formed by the developing agent transferred by the transfer roller 400 onto the paper P; a controller 10; a storage 20; and a surface detector 30.

The image forming apparatus 1000 forms a toner image on the photoreceptor 200 exposed by laser light emitted from the laser scanning optical device 100 and transfers the toner image onto the intermediate transfer belt 300. Next, the image forming apparatus 1000 presses and transfers the toner image transferred onto the intermediate transfer belt 300 onto the paper P by the transfer roller 400 and heats and pressurizes the paper P by the fixer 500 to fix the toner image on the paper P. Then, the image forming apparatus 1000 carries out image forming processing by conveying the paper P by a paper discharge roller (not illustrated) or other rollers and discharging the paper P to a tray (not illustrated).

Figure 3:
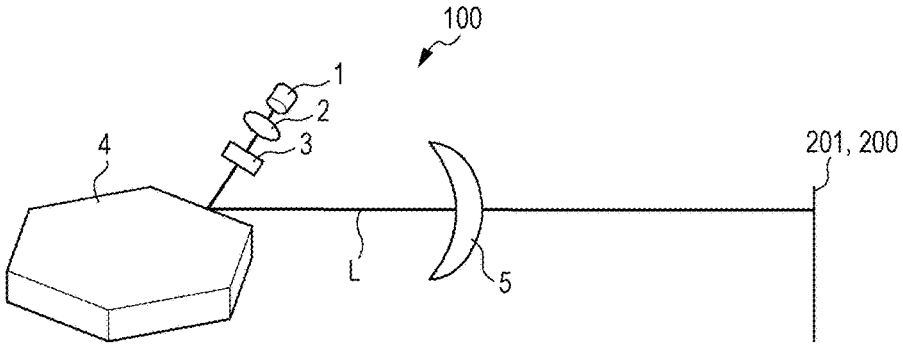
FIG. 3 is a diagram illustrating a schematic configuration of a laser scanning optical device.
Figure 4:
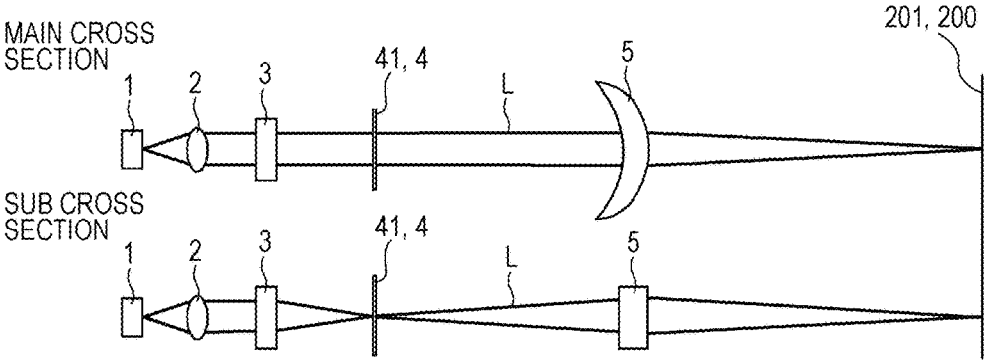
FIG. 4 includes diagrams schematically illustrating a main cross section and a sub cross section of the laser scanning optical device.

As illustrated in FIGS. 3 and 4, the laser scanning optical device 100 emits laser light (light flux) L to the photoreceptor 200 charged by the charger 210 to expose the photoreceptor 200. The laser scanning optical device 100 includes: a light source 1 for emitting laser light L; a collimator lens 2 for collimating the laser light L emitted from the light source 1; a cylinder lens 3 for converging only a sub scanning direction component of the laser light L transmitted through the collimator lens 2; a deflector 4 having a plurality of (six in the present embodiment) deflective reflection surfaces 41 for deflecting the laser light L transmitted through the cylinder lens 3 at a constant acceleration; and an fθ lens (scanning imaging optical system) 5 for condensing the laser light L deflected by the deflector 4 as a light spot on an irradiated surface (scanned surface) 201 of the photoreceptor 200. The laser scanning optical device 100 performs optical scanning on the irradiated surface 201 at a constant speed.

The light source 1 is a semiconductor laser that emits the laser light L. The laser light L emitted from the light source 1 is irradiated to the collimator lens 2.

The collimator lens 2 converts the laser light (diverging light) emitted from the light source 1 into parallel light.

The cylinder lens 3 converges, in the sub scanning direction, the laser light L converted into parallel light by the collimator lens 2.

Figure 5:
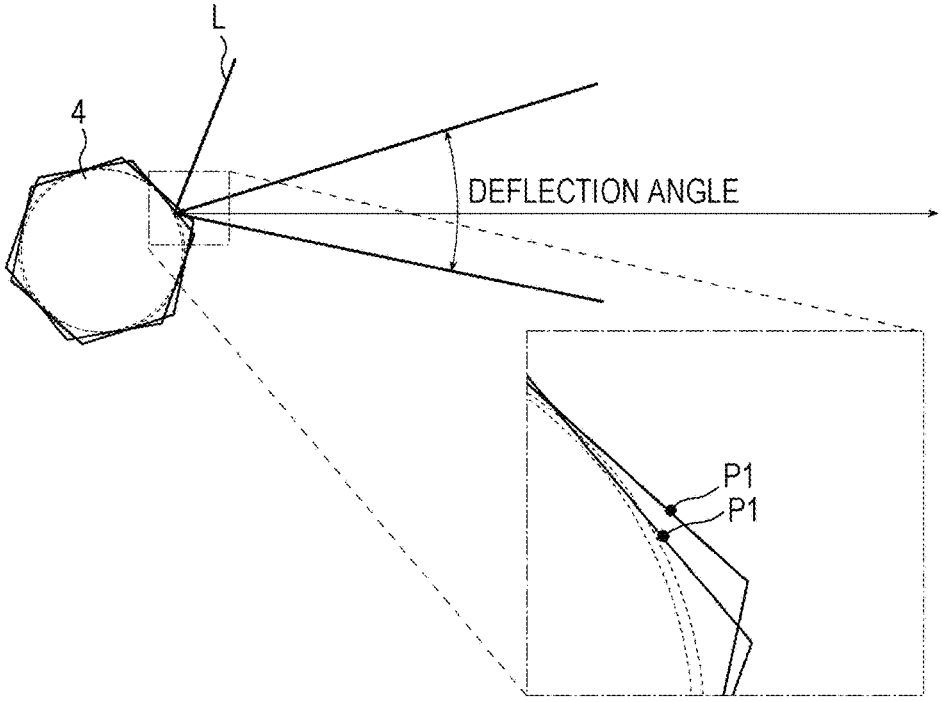
FIG. 5 is a diagram illustrating an example of how a deflection point moves as a deflector rotates.

The deflector 4 includes a polygon mirror having a polygonal prism shape side surfaces of which are mirror surfaces and a motor that rotates the polygon mirror by applying a turning force to the polygon mirror. As the deflector 4 rotates, a position (deflection point P1) for deflecting the laser light L transmitted through the cylinder lens 3 moves (see FIG. 5). That is, the deflector 4 deflects the laser light L in a direction according to the rotation. Then, the deflector 4 irradiates the deflected laser light L onto a peripheral surface of the photoreceptor 200 via the fθ lens 5. At this time, the deflector 4 irradiates the laser light L to different positions in the longitudinal direction of the photoreceptor 200 depending on a rotational position, thereby enabling scanning by the laser light L in the main scanning direction (axial direction of the photoreceptor 200).

The deflector 4 forms an image on a surface (irradiated surface 201) of the photoreceptor 200 when a deflective reflection surface 41 reflecting the laser light L is not tilted. When the laser scanning optical device 100 is viewed from a sub cross section, the deflector 4 and the irradiated surface 201 are in a conjugate relationship.

The fθ lens 5 condenses the laser light L deflected by the deflector 4 on the irradiated surface 201 of the photoreceptor 200 and forms an image.

The controller 10 includes a CPU, a RAM, and other components. The CPU reads out various processing programs stored in a storage device such as the storage 20, develops them in the RAM, and centrally controls the operation of each unit of the image forming apparatus 1000 according to the developed programs.

The storage 20 stores a program that can be read by the controller 10, a file used at the time of executing the program, and other data. As the storage 20, a large capacity memory such as a hard disk can be used.

The storage 20 further stores data (sub-irradiation position data) of a beam irradiation position in the sub scanning direction for each main image height on each of the deflective reflection surfaces 41.

The surface detector 30 is, for example, a sensor capable of reading an image and is arranged in the vicinity of the deflector 4. The surface detector 30 detects a deflective reflection surface 41 that deflects the laser light L out of the plurality of deflective reflection surfaces 41 of the deflector 4 and outputs the detection result to the controller 10. Specifically, the surface detector 30 reads an image on a surface other than the deflective reflection surfaces 41 of the deflector 4 (for example, an upper surface or a lower surface) to detect a mark for identifying a surface, the mark applied to the surface other than the deflective reflection surfaces 41, thereby detecting a deflective reflection surface 41 that deflects the laser light L. In this manner, the controller 10 can grasp in real time which deflective reflection surface 41 deflects the laser light L.

Note that the image writing device of the present invention includes at least the controller 10, the storage 20, and the surface detector 30 in addition to the laser scanning optical device 100.

[Tilting of Deflector]

Figure 6A:
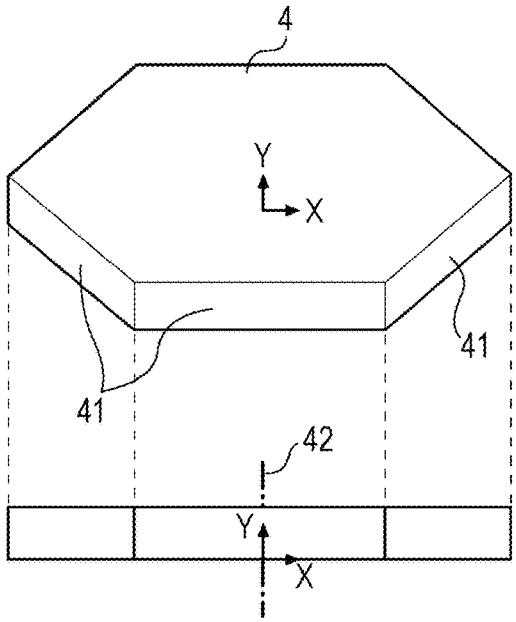
FIGS. 6A and 6B are diagrams illustrating tilting of the deflector.
Figure 6B:
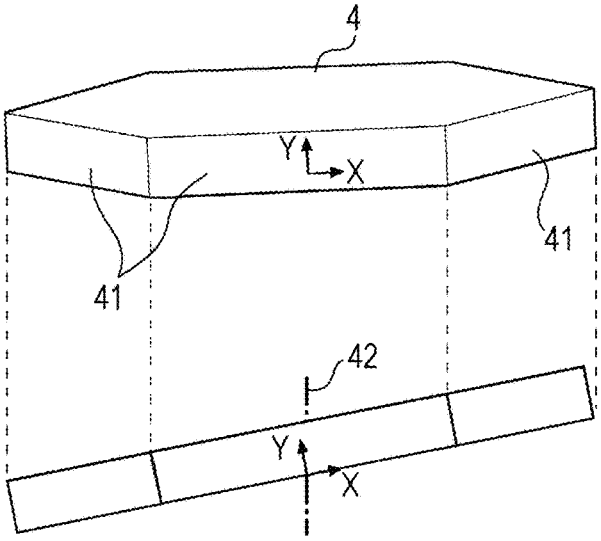

Next, tilting of the deflector 4 will be described with reference to FIGS. 6A and 6B. FIG. 6A illustrates an example where the deflector 4 is not tilted. FIG. 6B illustrates an example where the deflector 4 is tilted.

As illustrated in FIG. 6B, tilting of the deflector 4 refers to a phenomenon in which the deflective reflection surfaces 41 of the deflector 4 are inclined with respect to a rotational axis 42 of the deflector 4 in the longitudinal direction (X direction in FIGS. 6A and 6B) and the lateral direction (Y direction in FIGS. 6A and 6B).

[Scanning with Tilting Surface]

Figure 7A:
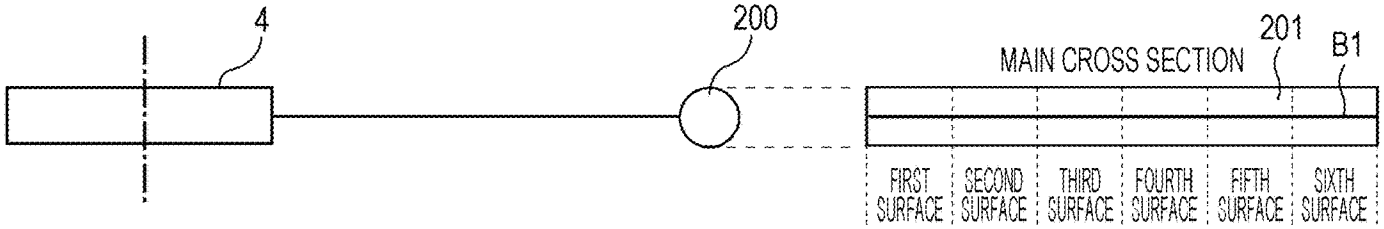
FIGS. 7A and 7B are diagrams illustrating examples of a relationship between tilting of the deflector and a scanning line.
Figure 7B:
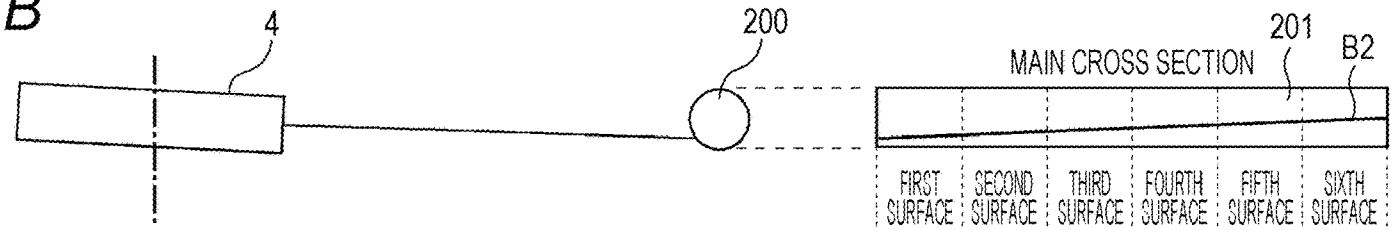

Next, scanning while the deflector 4 is tilted will be described with reference to FIGS. 7A and 7B. FIG. 7A illustrates an example of a scanning line on the irradiated surface 201 in the case where the deflector 4 is not tilted. FIG. 7B illustrates an example of a scanning line on the irradiated surface 201 in the case where the deflector 4 is tilted.

In the case where the deflector 4 is not tilted, as illustrated in FIG. 7A, a scanning line B1 scanned on the irradiated surface 201 is drawn on a linear line.

On the other hand, when the deflector 4 is tilted, as illustrated in FIG. 7B, a scanning line B2 scanned on the irradiated surface 201 is drawn with an inclination. Note that the scanning line B2 is not a linear line but a degree curve from the perspective of image height in the main scanning direction.

[Correction of Light Quantity Based on Beam Irradiation Position in Sub Scanning Direction Between Deflective Reflection Surfaces]

Figure 8:
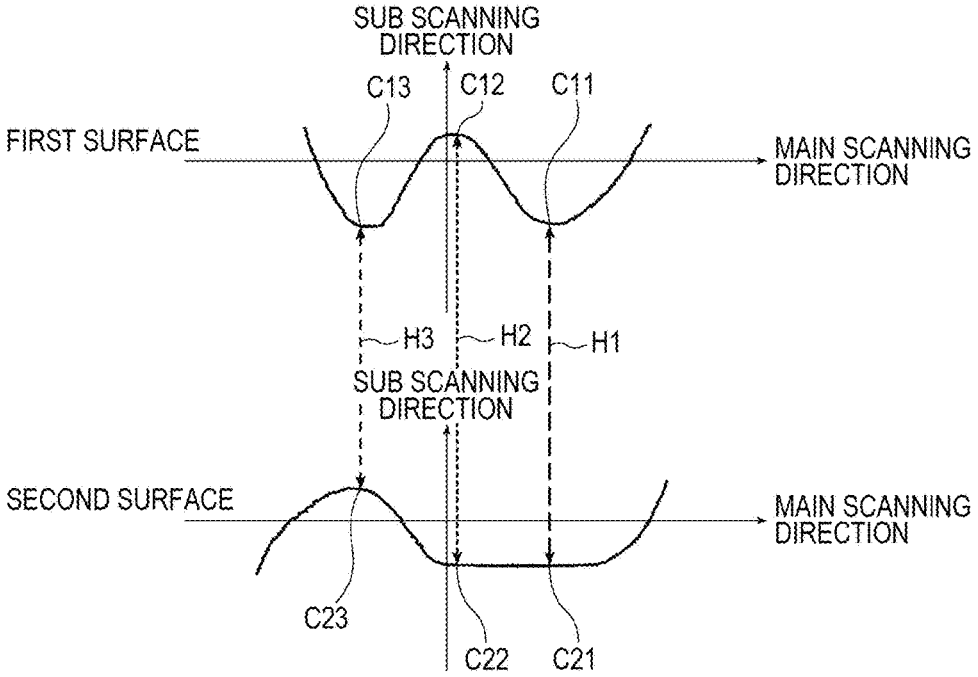
FIG. 8 is a diagram illustrating an example of a beam irradiation position in a sub scanning direction for each main image height on each deflective reflection surface.

Next, with reference to FIG. 8, correction of the light quantity based on a beam irradiation position in the sub scanning direction for each main image height between adjacent deflective reflection surfaces 41 will be described. FIG. 8 illustrates an example of a beam irradiation position in the sub scanning direction for each main image height on adjacent deflective reflection surfaces 41.

In the example illustrated in FIG. 8, an irradiation position difference H1 between a beam irradiation position C11 on a first surface and a beam irradiation position C21 on a second surface is normal (that is, an irradiation position difference in the case where the deflector 4 is not tilted). In this case, the controller 10 performs control so as to emit the normal light quantity without correcting the light quantity of the laser light L emitted from the light source 1.

In the example illustrated in FIG. 8, an irradiation position difference H2 between a beam irradiation position C12 of the first surface and a beam irradiation position C22 of the second surface is larger than the normal irradiation position difference H1. In this case, the controller 10 corrects to raise the light quantity of the laser light L emitted from the light source 1 at the main image height of the first and the second surfaces. This enables suppressing pitch unevenness occurring at the main image height of the first and the second surfaces.

In the example illustrated in FIG. 8, an irradiation position difference H3 between a beam irradiation position C13 of the first surface and a beam irradiation position C23 of the second surface is smaller than the normal irradiation position difference H1. In this case, the controller 10 corrects to reduce the light quantity of the laser light L emitted from the light source 1 at the main image height of the first and the second surfaces. This enables suppressing pitch unevenness occurring at the main image height of the first and the second surfaces.

Note that, as a method of controlling the light quantity, for example, a method of controlling a current value may be adopted, or a method of controlling the lighting time (pulse width) may be adopted.

[Influence on Image Quality Caused by Deviation in Beam Irradiation Position in Sub Scanning Direction Between Deflective Reflection Surfaces]

Figure 9A:
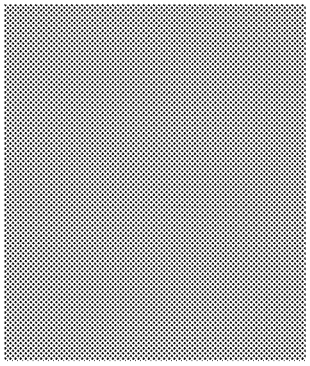
FIGS. 9A and 9B are diagrams illustrating an example of an influence on the image quality caused by a deviation of a beam irradiation position.
Figure 9B:
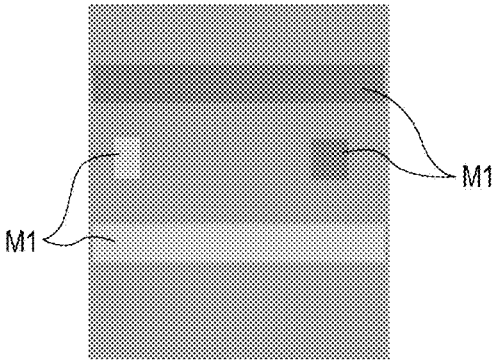

Next, with reference to FIGS. 9A and 9B, the influence on the image quality caused by a deviation in the beam irradiation position in the sub scanning direction for each main image height between adjacent deflective reflection surfaces 41 will be described. FIG. 9A illustrates an example of an image in the case where there is no deviation in the beam irradiation position. FIG. 9B illustrates an example of an image in the case where a deviation occurs in the beam irradiation position.

In a case where a deviation occurs in the beam irradiation position in the sub scanning direction for each main image height between the adjacent deflective reflection surfaces 41, as illustrated in FIG. 9B, density unevenness M1 occurs at some position.

Therefore, in the present embodiment, the beam irradiation position in the sub scanning direction is prestored in the storage 20 for each main image height on each of the deflective reflection surfaces 41, and the controller 10 controls to correct the light quantity of the laser light L to be irradiated to the beam irradiation position on the basis of a beam irradiation position corresponding to each main image height of a deflective reflection surface 41 detected by the surface detector 30. This enables outputting a uniform image without causing density unevenness at any place.

[Method of Collecting Data of Beam Irradiation Position in Sub Scanning Direction at Each Main Image Height]

Figure 10A:
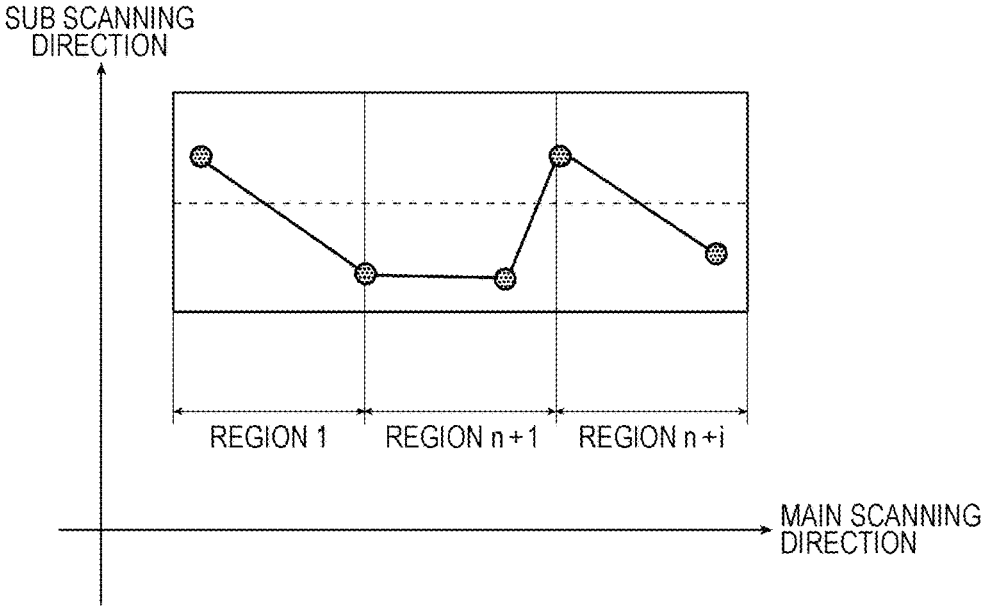
FIGS. 10A and 10B are graphs illustrating an example of a method of collecting data of a beam irradiation position in the sub scanning direction for each main image height on each deflective reflection surface.
Figure 10B:
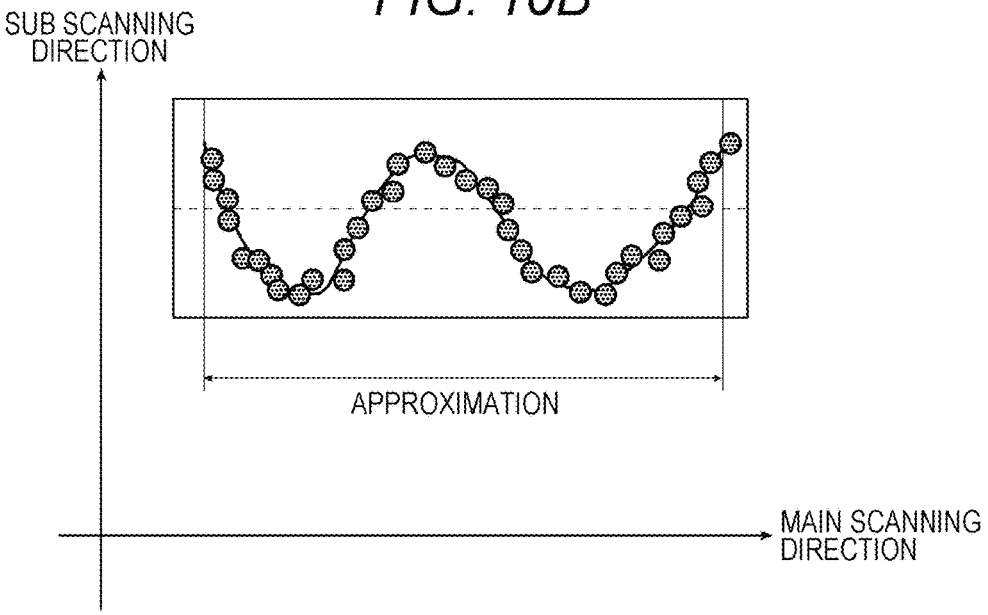

Next, with reference to FIGS. 10A and 10B, a method of collecting data of the beam irradiation position in the sub scanning direction at each main image height on each of the deflective reflection surfaces 41 will be described. FIG. 10A illustrates an example of a method of collecting data in which the beam irradiation position in the sub scanning direction is measured in each region obtained by equally dividing the main image height on each of the deflective reflection surfaces 41, and the measured beam irradiation positions are linearly complemented. FIG. 10B illustrates an example of a data sampling method in which the beam irradiation position in the sub scanning direction at the main image height on each of the deflective reflection surfaces 41 is collected to generate an approximate equation.

In the example illustrated in FIG. 10A, the main image height on each of the deflective reflection surfaces 41 are equally divided (three in FIG. 10A), and a beam irradiation position in the sub scanning direction is measured in each region. Linear complementation based on the measurement results in generation of data (sub-irradiation position data) of the beam irradiation position in the sub scanning direction. In this case, the controller 10 calculates a difference from an ideal position (difference from an ideal irradiation position) between adjacent deflective reflection surfaces 41 on the basis of the generated sub-irradiation position data and controls the light quantity on the basis of the calculated difference.

Meanwhile in the example illustrated in FIG. 10B, the beam irradiation position in the sub scanning direction is collected at the main image height on each of the deflective reflection surfaces 41, an approximate equation is generated on the basis of the collected data, and sub irradiation position data is generated on the basis of the generated approximate equation. In this case, like in the example illustrated in FIG. 10A, the controller 10 calculates a difference from an ideal position between adjacent deflective reflection surfaces 41 on the basis of the generated sub-irradiation position data and controls the light quantity on the basis of the calculated difference.

As described above, the image writing device of the image forming apparatus 1000 according to the present embodiment includes: the surface detector 30 for detecting a deflective reflection surface 41 that deflects the light flux (laser light L) out of the plurality of deflective reflection surfaces 41; the storage 20 for prestoring a beam irradiation position in the sub scanning direction corresponding to each main image height on each of the deflective reflection surfaces 41; and the controller 10 for controlling, on the basis of a beam irradiation position in the sub scanning direction corresponding to each main image height on the deflective reflection surface 41 detected by the surface detector 30 and prestored in the storage 20, the light quantity of the light flux to be irradiated to the beam irradiation position.

Therefore, according to the image writing device according to the present embodiment, the light quantity at a beam irradiation position in the sub scanning direction can be corrected for each main image height on each of the deflective reflection surfaces 41, it is possible to more accurately suppress pitch unevenness within each of the deflective reflection surfaces 41 and between deflective reflection surfaces 41 caused by tilting of the deflector.

Furthermore, according to the image writing device of the image forming apparatus 1000 according to the present embodiment, the controller 10 generates beam irradiation position data in the sub scanning direction by measuring a beam irradiation position in the sub scanning direction in each of the regions obtained by equally dividing the main image height on each of the deflective reflection surfaces 41 and linearly complementing the measured beam irradiation positions. Then, a difference from an ideal position between adjacent deflective reflection surfaces 41 is calculated on the basis of the generated beam irradiation position data, and the light quantity is controlled on the basis of the calculated difference.

Therefore, according to the image writing device according to the present embodiment, the amount of data processed by the controller 10 can be reduced, and thus the processing speed for correcting the light quantity can be increased.

Furthermore, according to the image writing device of the image forming apparatus 1000 according to the present embodiment, the controller 10 generates beam irradiation position data in the sub scanning direction by collecting a beam irradiation position in the sub scanning direction at the main image height on each of the deflective reflection surfaces 41 and generating an approximate equation. Then, a difference from an ideal position between adjacent deflective reflection surfaces 41 is calculated on the basis of the generated beam irradiation position data, and the light quantity is controlled on the basis of the calculated difference.

Therefore, according to the image writing device according to the present embodiment, the amount of data processed by the controller 10 can be reduced, and thus the processing speed for correcting the light quantity can be increased.

According to the image writing device of the image forming apparatus 1000 according to the present embodiment, the surface detector 30 detects the mark for identifying a surface, the mark applied to the surface other than the deflective reflection surfaces 41 of the deflector 4, thereby detecting a deflective reflection surface 41 that deflects the light flux.

Therefore, according to the image writing device according to the present embodiment, it is possible to accurately detect a deflective reflection surface 41 that deflects the light flux with a simple configuration. It is thus possible to accurately suppress pitch unevenness while an increase in size and cost of the device is suppressed.

According to the image writing device of the image forming apparatus 1000 according to the present embodiment, the controller 10 controls the light quantity by controlling a current value.

Therefore, according to the image writing device according to the present embodiment, the amount of adhering developing agent can be controlled, and thus pitch unevenness can be suppressed with high accuracy.

Moreover, according to the image writing device of the image forming apparatus 1000 according to the present embodiment, the controller 10 controls the light quantity by controlling the lighting time.

Therefore, according to the image writing device according to the present embodiment, the amount of adhering developing agent can be controlled, and thus pitch unevenness can be suppressed with high accuracy.

Although the present invention has been specifically described on the basis of the embodiments of the present invention, the present invention is not limited to the above embodiments and can be modified within a scope not departing from the principals thereof.

For example, the beam irradiation position in the sub scanning direction corresponding to each main image height on each of the deflective reflection surfaces 41 on an image surface defocused from an ideal image surface due to a temperature change in the device may be stored in the storage 20 in association with the temperature within the device (or the amount of focus due to a temperature change in the device). In this case, the controller 10 controls the light quantity of the light flux to be irradiated to a beam irradiation position on the basis of the beam irradiation position corresponding to the temperature measured by a temperature sensor arranged in the image writing device. Here, it is preferable that the temperature sensor is arranged in the vicinity of an optical element (for example, the cylinder lens 3 or the fθ lens 5) having a relatively large power in the sub scanning direction among the plurality of optical elements on the optical path of the laser light L. This is because arranging the temperature sensor in the vicinity of an optical element that is likely to influence defocusing due to a temperature change in the device facilitates accurately grasping the amount of focus due to the temperature change. Note that the vicinity of an optical element having a large power in the sub scanning direction refers to a position close to the extent that a temperature approximately the same as a temperature actually affecting the optical element can be measured.

With the above configuration, it is possible to accurately grasp a beam irradiation position even when defocusing occurs due to a temperature difference between the time of assembly of the device and the time of outputting an image, and thus it is possible to more accurately suppress pitch unevenness.

Especially, by arranging the temperature sensor in the vicinity of the optical element having a relatively large power in the sub scanning direction among the plurality of optical elements on the optical path of the laser light L, it is possible to more accurately detect the temperature difference between the time of assembly of the device and the time of outputting an image. Therefore, it is possible to grasp the beam irradiation position more accurately and to suppress pitch unevenness more accurately.

Note that, for example, the humidity inside the device may be stored in the storage 20 in association with the beam irradiation position instead of the temperature inside the device.

That is, an environment measurer (temperature sensor, humidity sensor, etc.) for measuring the environment (temperature, humidity, etc.) inside the device may be provided in order to store, in the storage 20 in association with the environment in the device, the beam irradiation position in the sub scanning direction corresponding to each main image height on each of the deflective reflection surfaces 41 on an image surface defocused from an ideal image surface. In this case, the controller 10 controls the light quantity of the light flux to be irradiated to a beam irradiation position on the basis of the beam irradiation position corresponding to the environment measured by the environment measurer arranged in the image writing device.

With the above configuration, it is possible to accurately grasp a beam irradiation position even when defocusing occurs due to a change in the environment between the time of assembly of the device and the time of outputting an image, and thus it is possible to more accurately suppress pitch unevenness.

Moreover, the beam irradiation position in the sub scanning direction corresponding to each main image height on each of the deflective reflection surfaces 41 on an image surface defocused from an ideal image surface due to an error of assembly may be stored in the storage 20 in association with the error of assembly. In this case, the controller 10 controls the light quantity of the light flux to be irradiated to a beam irradiation position on the basis of the beam irradiation position corresponding to the error of assembly stored in the storage 20.

With the above configuration, it is possible to accurately grasp a beam irradiation position even when defocusing occurs due to an error of assembly at the time of assembling the device, and thus it is possible to more accurately suppress pitch unevenness.

Furthermore, the amount of tilting of the deflector 4 and the amount of positional deviation of a conjugate point due to a curvature of an image surface of an optical element (e.g. fθ lens 5) for each main image height on each of the deflective reflection surfaces 41 may be prestored in the storage 20. In this case, on the basis of the amount of tilting and the amount of positional deviation of a conjugate point prestored in the storage 20, the controller 10 can calculate a beam irradiation position in the sub scanning direction corresponding to each main image height on each of the deflective reflection surfaces 41.

With the above configuration, it is unnecessary to measure and store in advance a beam irradiation position in the sub scanning direction corresponding to each main image height with respect to the amount of tilting of the deflector, and thus the amount of data processed by the controller 10 can be reduced, and the processing speed at the time of correcting the light quantity can be increased.

Meanwhile, the light source 1 in which the number of light emitting points of the laser is one is described as an example in the above embodiments; however, the present invention is not limited thereto. For example, the present invention can be applied even in a case where a light source 1 of multi-beam is adopted in which the number of light emitting points of the laser is two, four, eight, or other numbers.

In this case, it is preferable that a beam irradiation position in the sub scanning direction corresponding to each main image height on each of the deflective reflection surfaces 41 is prestored in the storage 20 for all the light emitting points. This enables accurately suppressing pitch unevenness.

Instead of storing the beam irradiation position for all the light emitting points, beam irradiation positions may be stored only for light emitting points at both ends in the sub scanning direction (uppermost end and lowermost end). In this case, the controller 10 controls the light quantity of the light emitting points at the both ends in the sub scanning direction on the basis of the beam irradiation position.

With the above configuration, it is unnecessary to store the beam irradiation position for all the light emitting points, and thus the amount of data processed by the controller 10 can be reduced, and the processing speed at the time of correcting the light quantity can be increased.

Note that a beam irradiation position of each beam can be calculated from a position of each light emitting point. Therefore, for example, storing the position information of light emitting points at the both ends in the sub scanning direction in the storage 20 enables calculating an irradiation position of beams emitted from the light emitting points at the both ends in the sub scanning direction. This allows the amount of data processed by the controller 10 to be reduced, and thus the processing speed for correcting the light quantity can be increased.

Furthermore, for example, position information of a light emitting point at the center in the sub scanning direction may be stored in the storage 20. In this case, since a pitch between light emitting points is known in advance, positions of the light emitting points at the both ends in the sub scanning direction can be specified from the position information of the light emitting point at the center in the sub scanning direction. Note that, in a case where the number of light emitting points is an even number, there are two light emitting points at the center (for example, in a case where the number of light emitting points is four, a second and a third light emitting points excluding those at the both ends are at the center). Position information of any one of the light emitting points may be stored, or position information of both of the light emitting points may be stored. That is, in an embodiment of the present invention, the light emitting point at the center in the sub scanning direction in a case where the number of light emitting points is an even number includes both of the case of two light emitting points and the case of only one of the light emitting points. Particularly in the case where the position information of only one of the light emitting points is stored, since the amount of data processed by the controller 10 can be further reduced, and thus the processing speed for correcting the light quantity can be further increased.

Furthermore, when a deviation (pitch deviation) occurs in the pitch in the sub scanning direction of each light emitting point, the amount of deviation may be measured to control the light quantity of the laser light L on the basis of the measured amount of deviation. For example, in a case where the pitch between light emitting points is larger than a normal pitch, the light quantity of the laser light L is corrected so as to be increased. Alternatively, in a case where the pitch between light emitting points is smaller than the normal pitch, the light quantity of the laser light L is corrected so as to be decreased.

With the above configuration, even when pitch deviation occurs in the sub scanning direction at one of light emitting points, the position of the light emitting point can be accurately grasped. Therefore, pitch unevenness generated by the pitch deviation of the light emitting point can be suppressed.

In the above embodiment, the surface detector 30 detects the mark for identifying a surface applied to a surface other than the deflective reflection surfaces 41; however, the present invention is not limited thereto. For example, special processing to reflect light in a specific direction (different directions for each edge) may be performed at an edge (boundary) portion between adjacent deflective reflection surfaces 41, and a sensor for detecting the light may be arranged at all the reflection destinations to detect which deflective reflection surface 41 is irradiated with the light.

In addition to the above, a detailed configuration and detailed operation of each device forming the image forming device can be modified as appropriate within the scope not departing from the principals of the present invention.

Although embodiments of the present invention have been described and illustrated in detail, the disclosed embodiments are made for purposes of illustration and example only and not limitation. The scope of the present invention should be interpreted by terms of the appended claims.

What is claimed is:

1. An image writing device comprising a deflector having a plurality of deflective reflection surfaces for deflecting light flux emitted from a light source at a constant acceleration and a scanning imaging optical system that condenses the light flux deflected by the deflector as a light spot on a scanned surface of a latent image carrier having a charge generation layer and a charge transport layer, the image writing device performing optical scanning on the scanned surface at a constant speed, wherein the image writing device further comprises:

a surface detector that detects a deflective reflection surface that deflects the light flux out of the plurality of deflective reflection surfaces;

a storage that prestores a beam irradiation position in a sub scanning direction corresponding to each main image height on each of the deflective reflection surfaces; and a hardware processor that controls, on the basis of a beam irradiation position in the sub scanning direction corresponding to each main image height on the deflective reflection surface detected by the surface detector, the beam irradiation position prestored in the storage, a light quantity of the light flux to be irradiated to the beam irradiation position.

2. The image writing device according to claim 1, further comprising:

an environment measurer that measures an environment inside the device, wherein the storage stores a beam irradiation position in the sub scanning direction corresponding to each main image height on each of the deflective reflection surfaces on an image surface defocused from an ideal image surface in association with the environment in the device, and the hardware processor controls a light quantity of the light flux to be irradiated to a beam irradiation position on the basis of the beam irradiation position corresponding to the environment measured by the environment measurer.

3. The image writing device according to claim 2, wherein the environment measurer is a temperature sensor that measures a temperature inside the device, the storage stores a beam irradiation position in the sub scanning direction corresponding to each main image height on each of the deflective reflection surfaces on an image surface defocused from an ideal image surface in association with the temperature in the device, and the hardware processor controls the light quantity of the light flux to be irradiated to a beam irradiation position on the basis of the beam irradiation position corresponding to the temperature measured by the temperature sensor.

4. The image writing device according to claim 3, wherein the temperature sensor is arranged in a vicinity of an optical element having a relatively large power in the sub scanning direction among a plurality of optical elements on an optical path of the light flux.

5. The image writing device according to claim 1, wherein the hardware processor generates beam irradiation position data in the sub scanning direction by measuring a beam irradiation position in the sub scanning direction in each of regions obtained by equally dividing a main image height on each of the deflective reflection surfaces and linearly complementing the measured beam irradiation positions, calculates a difference from an ideal position between adjacent deflective reflection surfaces on the basis of the generated beam irradiation position data, and controls the light quantity on the basis of the calculated difference.

6. The image writing device according to claim 1, wherein the hardware processor generates beam irradiation position data in the sub scanning direction by collecting a beam irradiation position in the sub scanning direction at a main image height on each of the deflective reflection surfaces and generating an approximate equation, calculates a difference from an ideal position between adjacent deflective reflection surfaces on the basis of the generated beam irradiation position data, and controls the light quantity on the basis of the calculated difference.

7. The image writing device according to claim 1, wherein the storage prestores the amount of tilting of the deflector and the amount of positional deviation of a conjugate point for each main image height on each of the deflective reflection surfaces.

8. The image writing device according to claim 1, wherein the surface detector detects a deflective reflection surface that deflects the light flux by detecting a mark for identifying a surface, the mark applied to a surface of the deflector other than the deflective reflection surfaces.

9. The image writing device according to claim 1, wherein the hardware processor controls the light quantity by controlling a current value.

10. The image writing device according to claim 1, wherein the hardware processor controls the light quantity by controlling lighting time.

11. The image writing device according to claim 1, wherein the light source has a plurality of light emitting points.

12. The image writing device according to claim 11, wherein the storage prestores a beam irradiation position in the sub scanning direction corresponding to each main image height on each of the deflective reflection surfaces with respect to light emitting points at both ends in the sub scanning direction out of the plurality of light emitting points, and the hardware processor controls the light quantity of the light emitting points at the both ends in the sub scanning direction on the basis of the beam irradiation position in the sub scanning direction corresponding to each main image height on the deflective reflection surface detected by the surface detector, the beam irradiation position prestored in the storage.

13. The image writing device according to claim 11, wherein the storage stores position information of the light emitting points at the both ends in the sub scanning direction out of the plurality of light emitting points.

14. The image writing device according to claim 11, wherein the storage stores position information of a light emitting point at a center in the sub scanning direction out of the plurality of light emitting points.

15. The image writing device according to claim 11, wherein the hardware processor controls the light quantity of the light flux to be irradiated to the beam irradiation position on the basis of pitch deviation in the sub scanning direction of each of the light emitting points.

16. An image forming apparatus comprising:

a latent image carrier;

a charger that charges the latent image carrier;

the image writing device according to claim 1, the image writing device forming an electrostatic latent image on the latent image carrier by irradiating, with light flux, the latent image carrier charged by the charger;

a developer that develops the electrostatic latent image into an image formed by a developing agent by supplying the developing agent to the latent image carrier irradiated with the light flux;

a transferor that transfers the image formed by the developing agent onto a paper; and a fixer that fixes, on the paper, the image formed by the developing agent and transferred by the transferor.

17. A pitch unevenness suppressing method of an image writing device including a deflector having a plurality of deflective reflection surfaces for deflecting light flux emitted from a light source at a constant acceleration and a scanning imaging optical system that condenses the light flux deflected by the deflector as a light spot on a scanned surface of a latent image carrier having a charge generation layer and a charge transport layer, the image writing device performing optical scanning on the scanned surface at a constant speed, the pitch unevenness suppressing method comprising:

controlling a light quantity of the light flux to be irradiated to a beam irradiation position on the basis of the beam irradiation position in a sub scanning direction corresponding to each main image height on a deflective reflection surface detected by a surface detector that detects a deflective reflection surface that deflects the light flux out of the plurality of deflective reflection surfaces, the beam irradiation position prestored in a storage that prestores the beam irradiation position in the sub scanning direction corresponding to each main image height on each of the deflective reflection surfaces.

* * * * *